United States Patent [19]

Benston et al.

[11] Patent Number: 5,025,504

[45] Date of Patent: Jun. 25, 1991

[54] LINER FOR A HELMET, HAT, CAP OR OTHER HEAD COVERING

[75] Inventors: Phyllis S. Benston, Auburn; Michael E. Cotie, Tacoma, both of Wash.

[73] Assignee: Weyerhaeuser Company, Tacoma, Wash.

[21] Appl. No.: 285,784

[22] Filed: Dec. 16, 1988

[51] Int. Cl.[5] ..... A42C 5/02

[52] U.S. Cl. ..... 2/181.4; 2/181.8; 2/183; 2/412

[58] Field of Search ..... 2/181, 181.2, 181.4, 2/181.6, 181.8, 182.2, 182.5, 183, 209, 414, 197, 412

[56] References Cited

U.S. PATENT DOCUMENTS

| | | | |
|---|---|---|---|
| 758,806 | 5/1904 | Anderson | 2/181 |
| 1,131,043 | 3/1915 | Decker | 2/181.6 |
| 1,571,827 | 7/1925 | Wharton | 2/181 |
| 1,775,561 | 9/1930 | Kanner | 2/181 |
| 2,445,209 | 7/1948 | Clark | 2/181.4 |
| 3,027,564 | 4/1962 | Wagenfeld | 2/181 |
| 3,570,491 | 3/1971 | Sneider | 604/366 |
| 3,578,736 | 5/1971 | Dootson | 2/181 |
| 3,805,790 | 4/1974 | Kaczmarzyk et al. | 604/369 |
| 3,881,490 | 5/1975 | Whitehead et al. | 604/366 |
| 3,882,547 | 5/1975 | Morgan | 2/414 |
| 4,020,507 | 5/1977 | Morton | 2/411 |
| 4,060,855 | 12/1977 | Rappleyea | 2/413 |
| 4,274,157 | 6/1981 | Boden | 2/181.4 |
| 4,308,623 | 1/1982 | Voorhees | 2/209 X |
| 4,347,092 | 8/1982 | Hlaban et al. | 156/227 |
| 4,354,284 | 10/1982 | Gooding | 2/413 |
| 4,434,514 | 3/1984 | Sundahl et al. | 2/181.6 X |
| 4,468,817 | 9/1984 | Nunnery et al. | 2/181 |
| 4,502,156 | 3/1985 | Wishman | 2/181 |
| 4,540,414 | 9/1985 | Wishman | 604/378 |
| 4,619,055 | 10/1986 | Davidson | 36/28 |
| 4,626,247 | 12/1986 | Frankel | 2/425 X |
| 4,627,115 | 12/1986 | Broersma | 2/425 |
| 4,653,123 | 3/1987 | Broersma | 2/425 |
| 4,815,144 | 3/1989 | Martin | 2/181 X |
| 4,883,734 | 5/1989 | Der Estephanian | 2/171 |
| 4,886,697 | 12/1989 | Perdelwitz, Jr. et al. | 428/192 |

*Primary Examiner*—Peter Nerbun

*Attorney, Agent, or Firm*—Klarquist, Sparkman, Campbell, Leigh & Whinston

[57] ABSTRACT

A liner for helmets, hats, caps or other head coverings has a body with a central section and tapered end sections. The body includes liquid absorbing material and is releasably secured to the head covering for easy replacement. The liners are typically disposable and may be formed with a core of thermoplastic containing other fibers sandwiched between facing and backing sheets. The edges and transversed sections of the body may be densified. Optionally, the liner may be cut in these transverse densified areas to adjust its length.

15 Claims, 1 Drawing Sheet

LINER FOR A HELMET, HAT, CAP OR OTHER HEAD COVERING

BACKGROUND OF THE INVENTION

The present invention relates to liners for helmets, hats, welding masks, safty shields, caps or other head coverings and more specifically to limited life or disposable liners for use with head coverings.

It is desirable to provide for the removal of moisture in the form of perspiration and the like from the skin of human beings. Perspiration generated by humans, particularly those involved in physical exercise and labor, can run down from an individual's head and into his or her eyes and can also drip on undesirable areas, such as onto a workpiece. A common method of removal of such moisture involves the placement of moisture-absorbent cloth, such as cotton terrycloth or the like, against an individual's skin. The use of headbands of moisture absorbent cloth is common among participants in athletics to keep perspiration from flowing into eyes and impairing the vision of the exercising individuals. Similarly, hats are commonly provided with sweat bands to absorb perspiration from the head of a hat wearer.

Examples of known prior art approaches for trapping perspiration from a user's head are as follows.

U.S. Pat. No. 4,653,123 of Broersma discloses a perspiration absorbing pad extending arcuately at the front of a helmet interior and which is bonded to an interior wall surface of a helmet liner.

U.S. Pat. Nos. 4,502,156 and 4,540,414 of Wishman disclose, at FIG. 6, a hat or sweat band secured within and around the crown of a hat. The sweat band comprises a strip of non-woven fabric having an unfused side facing inwardly to engage the head of the wearer of the hat in a moisture-conducting relationship. The strip of fabric has a fused side disposed adjacent to an inner surface of an interior moisture absorbent strip to facilitate the transfer of moisture to this latter strip. The outer surface of the interior moisture absorbent strip is positioned against a substantially moisture-impervious backing sheet or strip which contacts the inner surface of the crown of the hat. The lower edges of the elements forming the sweat band are secured about the lower periphery of the crown by a suitable means with stitching being the specifically mentioned approach.

U.S. Pat. No. 4,434,514 of Sundahl et al. discloses a generally rectangular perspiration absorbing pad which is frictionally retained by adjacent inner edges of padding in a helmet. The absorbing pad is removable and has multiple air flow openings. When this pad is soaked with perspiration, it is removed, wrung out and replaced. The padding which frictionally retains the removable pad in place is bonded to an inner surface of a liner of the helmet.

U.S. Pat. No. 4,627,115 of Broersma discloses a helmet with a removable pad for absorbing perspiration. The pad is described as including a porous fabric interliner, for example, of porous polypropylene, with the pad itself consisting, for example, of reticulated polyethylene foam.

Finally, U.S. Pat. No. 1,571,827 of Wharten discloses a sweat band for hats formed by folding an elongated strip and, in one form, with padding inserted into or between the folded layers.

Although prior art liners are known, a need exists for an improved limited life or disposable liner for helmets, hats, caps and other head coverings.

SUMMARY OF THE INVENTION

In accordance with the present invention, a liner for a helmet, hat, cap or other head covering has an elongated body which includes a moisture absorbing material. In a preferred form of the invention, the body has a central portion and first and second end portions, the first and second end portions terminating in respective first and second ends which are each spaced from the central portion. The first end portion is tapered from the central portion to the first end and the second end portion is tapered from the central portion to the second end. This tapering facilitates the positioning of the liner in the crown or headband area of a hat or other head covering without the ends of the liner sticking below the hat. Although other shapes are possible, a preferred form of the invention comprises a liner of a generally trapezoidal shape.

In accordance with another aspect of the present invention, the body includes a back surface with adhesive means for releasably securing the liner to the interior of the head covering. An adhesive coating may be used for this purpose with a release paper or covering overlaying and protecting the adhesive area prior to mounting the liner in position.

As a more specific aspect of the present invention, the liner may be comprised of a core of fibrous material sandwiched between facing and backing sheets. The facing and backing sheets are typically of a non-woven liquid permeable material, although the backing sheet may be of a liquid impermeable material to shield the head covering from moisture absorbed into the core of the liner.

As a further aspect of the present invention, the liner may comprise a plural segmented body with the segments being defined by transversely extending densified areas. The body may be severed along these densified areas, as desired, to size the length of the body to fit a particular head covering. These densified areas help prevent the escape of fibers from the core. In addition, the edges of the body may also be densified. Furthermore, the core may be formed of thermoplastic or thermoplastic containing fibers and other fibers and the facing and backing sheets may be formed of thermoplastic or thermoplastic containing materials. Consequently, these materials are heat fusible and may be joined together by heat fusing.

It is accordingly one object of the present invention to provide an improved liner for helmets, hats, caps and other head coverings.

It is another object of the present invention to provide a highly absorbent liner for head coverings.

Another object of the present invention is to provide a liner for head coverings which may be easily installed and removed and which is relatively inexpensive so that it ma be disposed of following soiling or use.

These and other objects, features and advantages of the present invention will become apparent with reference to the following description and drawings.

DETAILED DESCRIPTION OF THE PREFERRED EMBODIMENTS

Figure 1:
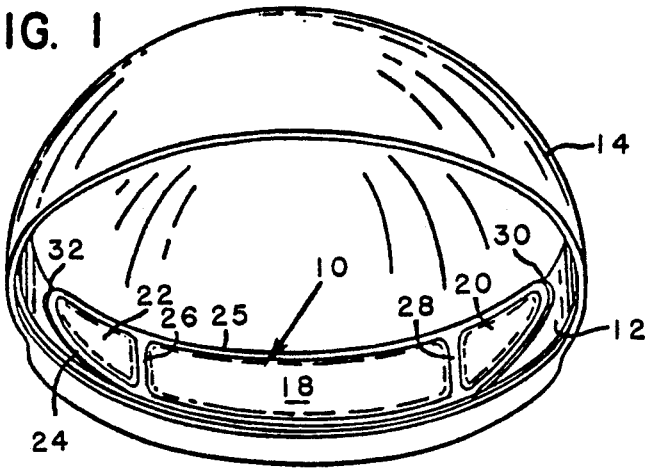
FIG. 1 is an isometric view of one form of a helmet or hat to which a liner in accordance with the present invention has been mounted.

For convenience, and with reference to FIG. 1, a liner 10 in accordance with the present invention is shown installed on an interior liner surface or band 12 of a safety helmet 14. The illustrated liner is shown mounted at the front of the helmet and extending across the area of the band 12 that would otherwise engage a user's forehead and portions of a user's temples. Of course, the liner may be used in connection with other types of head coverings as well, such as hats, caps, surgical head coverings, wigs, safty, helmet, welding masks, and so forth. The liner of the present invention has particular applicability to situations wherein the user is likely to perspire heavily, such as when engaged in athletic events and when performing manual labor. In addition, the liner also is particularly useful in applications wherein perspiration otherwise dripping from an individual's head can cause damage, such as during surgery or in clean room electronic assembly applications. In addition, the ready removal and replacement characteristics of the liner of the invention are extremely beneficial in fields wherein multiple users wear the same head covering, such as is the case in a costume rental business where people rent the same costumes. By simply removing and replacing the liner between rentals, sanitation is improved. Again, it is to be understood that the use of the liner of the present invention is not limited to any particular type of head covering.

Figure 2:
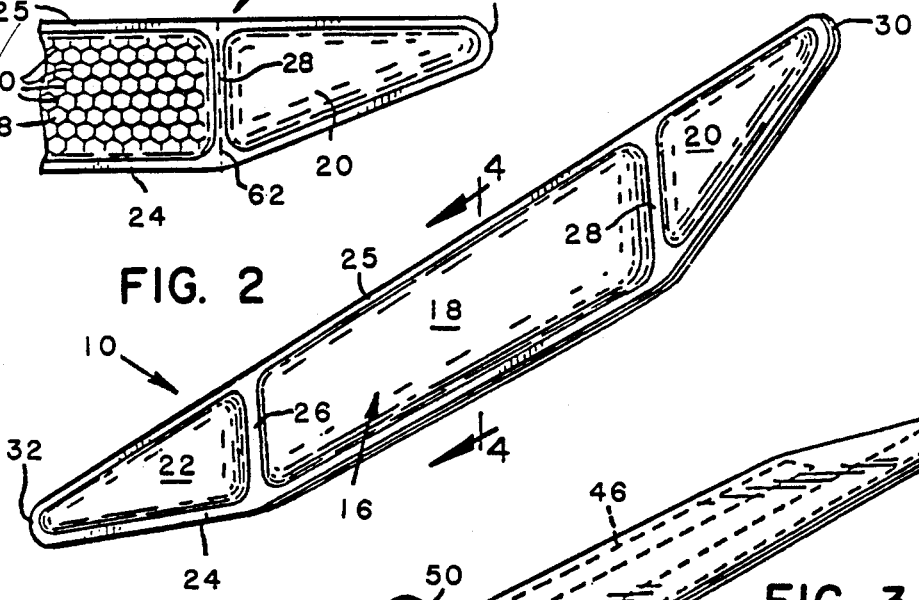
FIG. 2 is a front isometric view of a liner in accordance with the present invention.

With reference to FIG. 2, the liner 10 of the present invention is elongated, being much longer than wide and relatively thin. The liner includes a body 16 which has a central portion or section 18, a first end portion or section 20 and a second end portion or section 22. The lower edge 24 of the body is typically recessed from the outermost exposed surfaces of the sections 18, 20 and 22. Similarly, the upper edge 25 is also recessed. In addition, transversely extending recessed regions 26, 28 are defined in the body and separate the respective body sections 22, 18 and 18, 20. The ends of the body are indicated in FIG. 2 at 30, 32.

As shown in FIG. 2, the respective end sections 20, 22 taper or narrow in width moving in a direction from the center section toward the respective ends 30, 32 of the liner 10. This tapering makes the liner easier to fit within the confines of a helmet 14 without the end sections 20, 22 hanging downwardly below the lower edge of the helmet in comparison to the case where the end sections are rectangular. Although other shapes are suitable, the illustrated preferred embodiment of the liner is generally of a trapezoidal shape with somewhat truncated ends 30, 32. The upper edge 25 of the liner forms the long side of this trapezoidal shape and is positioned in the helmet 14 (FIG. 1) at a location spaced from, but generally parallel to, the lower edge of the helmet. When the liner 10 is in position, the portion of the lower edge 24 along the central section 18 is typically adjacent to the lower edge of the helmet.

Although variable, one specific example of a liner in accordance with the invention is about ten and one-half inches long and one and one-half inches wide. In addition, the edges 24, 25 and recessed areas 26, 28 are about one-eighth inch wide. Also, the width of the body 16 is approximately one and one-half inches in the center section 18 thereof and the body tapers to approximately one-half inch wide at the ends 30, 32. In addition, in this specific example, the undensified portion of the center section 18 was approximately five and three-eighths inches long and one and one-quarter inches wide. Also, the undensified portion of each of the end sections 20, 22 was approximately two and three-eighth inches long.

It is desirable for liners of the present invention to be absorbent so as to capture and retain perspiration that may occur. Secondarily, it is desirable that the liner provide some insulation against hot and cold temperatures to provide greater comfort to a user who happens to pick up a helmet that has been in the sun or out in the cold. In addition, the liner should be sufficiently durable to maintain its integrity during use and should not be easy to pull apart. Also, liners 10 of the disposable type should be relatively inexpensive and cost effective to manufacture so that they can be discarded when they become soiled.

The materials used in a liner in accordance with the present invention may be of many different types. Natural and synthetic materials, including various types of paper and fiber may be used. For purposes of illustration and in accordance with a preferred form of the invention, the body 16 may be formed of multiple layers including a core 40 sandwiched between a face sheet 42 and a backing sheet 44.

The face sheet is typically of a non-woven material which may be imprinted with a design. The non-woven material is liquid permeable and allows perspiration to pass through it and into the absorbent core layer 40. Typical facing layers are of materials such as spun laced, resin bonded, spun bonded or carded thermoplastic containing or thermoplastic materials such as polyester and polypropylene.

The core layer may be of wood pulp or other fibers, but is typically a combination of thermoplastic or thermoplastic containing fibers and other fibers, such as chemical wood pulp and Pulpex ®. Pulpex ® is a material which is available from Hercules Corporation and is described in U.S. Pat. No. 4,458,542. Other thermoplastic or thermoplastic containing materials may also be used. A typical mixture is comprised of eighty percent by weight pulp and twenty percent by weight Pulpex ®. However, mixtures of from sixty to ninety-five percent pulp and five to forty percent thermoplastic materials are suitable. Super absorbents may also be added.

The core material 40 is applied in an amount of between one hundred and five hundred $gm/m^2$ as a typical example, with 200 $gm/m^2$ being a preferred example. In addition, during formation, the core and facing sheet are typically heated so that the core fibers become thermobonded together and also become thermobonded to the facing sheet.

The backing sheet 44 may be of a thermoplastic containing or thermoplastic liquid impermeable material, such as of a polyethylene or polypropylene film. This material provides an effective water barrier to prevent moisture entering the core from passing to the helmet liner 12 (FIG. 1). However, more typically the backing sheet 44 is formed of the same material as the facing sheet, such as of a non-woven polyester or polypropylene.

Figure 6:
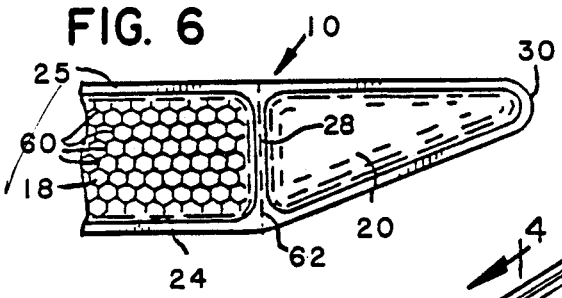
FIG. 6 is a front view of a portion of an alternative form of liner in accordance with the present invention.

The facing sheet, backing sheet and core can initially be heated to partially fuse these materials together. Thereafter, the edges 24, 25 and recessed areas 26, 28 may be formed by embossing under heat and pressure to heat fuse these edges together. In addition, all or portions of the lofty areas of the liner between the heat fused regions may be lightly embossed, such as shown in FIG. 6 in which a honeycomb pattern 60 is formed on body section 18, as desired.

Typically the density of the edges 24, 25 and of the recessed areas 26, 28 ranges from about 0.030 to 0.65 gm/cc with a specific example being 0.036 gm/cc. In addition, the lofty unbonded areas of the sections 18, 20 and 22 typically ranges in density from about 0.050 to 0.075 gm/cc with a specific example being 0.062 gm/cc. In addition, the lightly embossed areas, such as 60, typically range in density from about 0.075 gm/cc to 0.10 gm/cc with 0.087 gm/cc being a specific example.

In addition, the absorbency of the lofty areas of the sections 18, 20 and 22 is typically about nine grams of water per gram of core material when these lofty areas are not embossed and seven grams of water per gram of core material when the light embossing is used. Thus, a highly absorbent, yet durable, liner is provided.

The densified or recessed areas 26, 28 facilitate the adjustment of the liner as to length. That is, the liner may be cut along these transversely extending densified areas to adjust and alter the length of the liner as desired. By cutting the liner in these densified areas, sealed edges remain around the remaining portions of the liner, such as around central section 18. Consequently, shedding or dusting of fibers from the core is minimized. As shown in FIG. 6, perforations 62 may be provided along these transverse densified areas (i.e., shown for area 28 in this Figure) to facilitate severing of the liner to adjust its length. Also, the liner can of course be cut at locations other than in densified areas as required.

Figure 4:
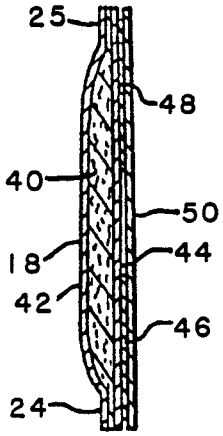
FIG. 4 is a cross-sectional view of the liner of FIG. 2, taken along line 4—4 thereof.
Figure 3:
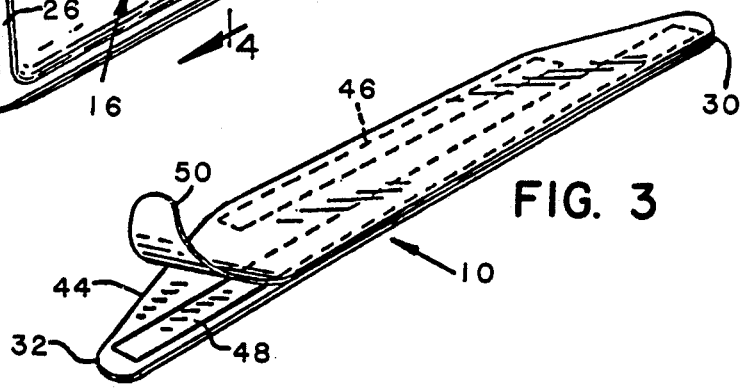
FIG. 3 is an isometric view of a liner in accordance with the present invention looking from the back thereof and showing one form of an adhesive securing system and an adhesive covering sheet.

The liner 10 may be releasably secured to the helmet 14. As shown in FIGS. 3 and 4, an adhesive type fastening system such as comprised of plural adhesive tape strips 46, 48 may be used to accomplish this fastening. These tapes utilize an adhesive which sticks to materials normally used for helmets. These materials include vinyls, cloths, and high impact plastics. The liner 10 should also be easily removable without leaving an adhesive residue or film, and without causing the permanent liner of the helmet to deform. Typical adhesive tapes that meet these requirements include commercially available product 401 and 404 adhesive tapes from the 3M Company of St. Paul, Minn. Such an adhesive system prevents the liner 10 from curling back on itself during use. A release paper or covering sheet 50 overlies the double-backed tape strips 46, 48 and is removed prior to securing the liner to the helmet 12.

Figure 5:
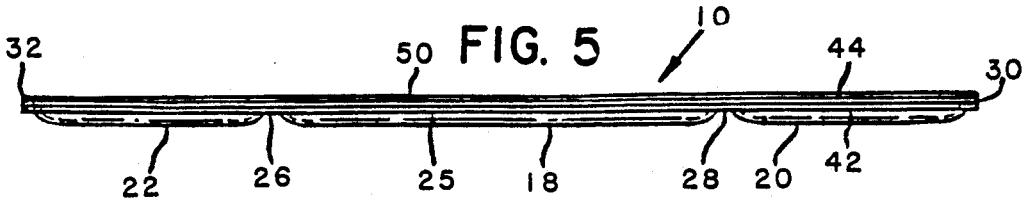
FIG. 5 is an edge view of an alternative form of liner in accordance with the present invention.

In FIG. 5, the covering sheet 50 is shown immediately adjacent to the outer surface of backing sheet 44. This is because the FIG. 5 form of the invention eliminates the double-backed tapes 46, 48 and instead employs an adhesive coating which is applied to all or portions of the outer surface of the backing sheet 44. Commercially available hot-melt contact adhesives sprayed on to this surface may be used, one such suitable adhesive being hot melt 70-2908 adhesive which is available from the National Starch Company.

Following assembly, the liners 10 are typically cut from a sheets which contain multiple liners, for example, by a die, water-knife or laser. The optional perforations 62 may also be formed at this time, for example, by placing a screen or perforated template over the area to be perforated. A water-knife is then passed over the template to form the perforations. Also, the perforations can be formed by interrupting a water-knife stream or laser as cuts are being made to form the perforations. Mechanical deflectors or an air stream may selectively deflect the water-knife stream away from the article to interrupt the water-knife and form the perforations. Also, with the liner being bonded as described, the edges are sealed with all three layers extending to and forming the edge. This strengthens the edge and minimizes the escapement of dust.

Having illustrated and described the principles of our invention with reference to several preferred embodiments, it will be apparent to those of ordinary skill in the art that the invention may be modified in arrangement and detail without departing from such principles. For example, other suitable materials for the liner may be used in place of those described. Also, the dimensions may be varied from the dimensions described above. Therefore, we claim as our invention all such modifications as come within the scope of the following claims.

We claim:

1. A liner for a helmet, hat, cap or other head covering to be worn by a user comprising:

an elongated body which includes a moisture absorbing material, a central portion and first and second end portions, the first and second end portions terminating in respective first and second ends which are each spaced from the central portion, the first end portion being tapered from the central portion to the first end and the second end portion being tapered from the central portion to the second end and the body including a back surface with adhesive means for releasably securing the liner to the head covering, the liner being sized so as to engage the forehead and portions of the temples of the user.

2. A liner according to claim 1 in which the body is of a generally trapezoidal shape.

3. A liner according to claim 1 including removable covering means for covering the adhesive means prior to securing the inner to the head covering.

4. A liner according to claim 3 in which the adhesive means comprises an adhesive coating applied to at least a portion of the back surface of the body.

5. A liner according to claim 1 in which the body has a core comprised of absorbent fibers, a liquid permeable face sheet and a backing sheet with the core sandwiched between the facing sheet and the backing sheet.

6. A liner according to claim 4 in which the facing and backing sheets are each of a liquid permeable nonwoven material.

7. A liner for a helmet, hat, cap or other head covering to be worn by a user comprising:

an elongated body which includes a moisture absorbing material exposed along an external surface of the body for absorbing moisture from the head of the user, the body comprising fibers and having plural segments defined by transversely extending densified fiber regions, the segments facilitating optional severing of the body in the transversely extending densified regions to adjust the length of the body.

8. A liner for a helmet, hat, cap or other head covering to be worn by a user comprising:

an elongated body which includes a moisture absorbing material exposed along an external surface of the body for absorbing moisture from the head of the user, the body having plural segments defined by transversely extending densified regions, the body also having a heat fusible material with the densified regions formed by heat fusing the body, with the segments facilitating optional severing of the body in the transversely extending densified regions to adjust the length of the body.

9. A liner according to claim 8 in which the edges of the body are also heat fused.

10. A liner for a helmet, hat, cap or other head covering to be worn by a user comprising:

an elongated body which includes a moisture absorbing material exposed along an external surface of the body for absorbing moisture from the head of the user, the body having plural segments defined by transversely extending densified regions, the body also including a core of thermoplastic and other fibers, a face sheet of a non-woven liquid permeable thermoplastic material, a backing sheet of a non-woven liquid permeable thermoplastic material, with the core, face and back sheets being heat fused together along the edges and along the transversely extending densified regions, and with the segments facilitating optional severing of the body in the transversely extending densified regions to adjust the length of the body.

11. A liner according to claim 10 in which the back sheet includes adhesive means for releasably securing the liner to the head covering.

12. A liner according to claim 11 including removable release covering means for covering the adhesive means prior to securing the liner to the head covering.

13. A liner according to claim 12 in which the adhesive means comprises an adhesive coating applied to at least a portion of the surface of the back sheet of the liner.

14. A liner according to claim 13 in which the plural segments of the body include a central section and first and second end sections, the first and second end sections terminating in respective first and second ends which are each spaced from the central section, the first end sections being tapered from the central section portion to the first end and the second end section being tapered from the central section to the second end.

15. A liner according to claim 14 in which the body is of a generally trapezoidal shape.

* * * * *